US006583361B2

(12) United States Patent
Clouet et al.

(10) Patent No.: US 6,583,361 B2
(45) Date of Patent: Jun. 24, 2003

(54) FLEXIBLE COAXIAL CABLE AND A METHOD OF MANUFACTURING IT

(75) Inventors: Pascal Clouet, Gregy sur Yerres (FR); Jean-François Guinot, Bondoufle (FR); Jean-Jacques Maisseu, Reims (FR); François Vaille, Corbeil Essonnes (FR)

(73) Assignee: Nexans, Paris (FR)

( * ) Notice: Subject to any disclaimer, the term of this patent is extended or adjusted under 35 U.S.C. 154(b) by 0 days.

(21) Appl. No.: 09/863,310

(22) Filed: May 24, 2001

(65) Prior Publication Data

US 2002/0003046 A1 Jan. 10, 2002

(30) Foreign Application Priority Data

May 25, 2000 (FR) ..... 00 06689

(51) Int. Cl.[7] ..... H01B 11/06
(52) U.S. Cl. ..... 174/108
(58) Field of Search ..... 174/106 R, 108, 174/109, 36

(56) References Cited

U.S. PATENT DOCUMENTS

| | | | | |
|---|---|---|---|---|
| 3,636,234 A | | 1/1972 | Wakefield | |
| 3,644,662 A | * | 2/1972 | Salahshourian | 174/73.1 |
| RE30,228 E | * | 3/1980 | Silver et al. | 174/36 |
| 4,340,771 A | * | 7/1982 | Watts | 174/106 D |
| 4,694,122 A | | 9/1987 | Visser | |
| 4,894,488 A | * | 1/1990 | Gupta | 156/51 |
| 5,293,001 A | * | 3/1994 | Gebs | 174/102 R |
| 5,442,131 A | * | 8/1995 | Borgwarth | 165/104.33 |
| 5,574,260 A | * | 11/1996 | Broomall et al. | 174/102 R |

* cited by examiner

*Primary Examiner*—Chau N. Nguyen
(74) *Attorney, Agent, or Firm*—Sughrue Mion, PLLC

(57) ABSTRACT

A flexible coaxial cable includes a shield formed by at least one metal tape provided with a metal coating and wound helically around the insulated core of the cable. The shield is sealed to itself in leakproof manner by the coating which is melted so as to bond directly together the overlapping turns of a single tape or the overlapping turns of two superposed tapes by subjecting the cable provided with the shield to peripheral induction heating.

15 Claims, 1 Drawing Sheet

FLEXIBLE COAXIAL CABLE AND A METHOD OF MANUFACTURING IT

The present invention relates to flexible coaxial cables and more particularly to such cables of small section suitable for use in particular in medical imaging, or in portable transmission equipment such as computers, or for conveying microwaves.

One of the requirements that needs to be satisfied is that the outer conductor or shield of such a cable must remain fully effective even though the cable, and thus the shield, are flexible.

BACKGROUND OF THE INVENTION

Document GB-A-2 130 430 discloses a flexible coaxial cable which has a flexible conductive core, flexible insulation around said core, a conductive shield that is likewise flexible around said insulation, and an optional flexible outer protective sheath. The shield of the cable is constituted by an inner metal tape which is folded longitudinally around the insulation, an outer metal tape which is wound helically around the inner tape, and an optional metal braid, which is then mounted around the outer tape and is designed to enable connections to be made to the shield at the ends of the cable. The edges of the inner tape overlap and are bonded together along the cable, and the edges of the outer tape overlap widely from one turn to the next. Each of the tapes can be made of a single metal or can be made of a composite material, e.g. tinned copper or a plastic/metal laminate.

In that known cable, the outer tape serves to cover any cracks or breaks that might appear in the inner tape under the effect of the cable being bent/straightened. Nevertheless, the turns themselves tend to move during such bending/straightening of the cable, thereby changing the contact resistance and the assembly configuration of the turns relative to one another and relative to the inner tape, leading to current flowing along a helical path in the outer tape and thus limiting the performance of the shield.

Document EP-A-0 236 096 also discloses a flexible coaxial cable which avoids the drawbacks of the cable known from the above-mentioned document, and to this end it has a shield comprising a copper tape placed longitudinally or wound helically around the insulation and having overlapping edges, a copper braid placed around the tape, and a layer of metal closing the opening along the overlapping edges of said tape and the interstices in the braid and securing the braid to said tape, such that the shield is flexible and without openings.

To manufacture such a cable, after the shield and the braid have been put into place, the cable is passed through a bath of molten metal, specifically solder. While the molten metal is being applied, the tape acts as a thermal shield so as to isolate the insulation thermally from the molten metal, given that in the absence of the tape, the molten metal would come directly into contact with the insulation and could harm it.

The coaxial cable obtained in that way is flexible while also having a shield that provides high performance. Nevertheless, the layer of metal between the braid and the tape is not of uniform thickness all around the cable, because of the fluidity of the metal in the molten state. In addition, the method of manufacturing such a shield is lengthy and not very convenient. As mentioned in that document, it cannot be performed continuously in line because of the very different speeds used in the different stages of the method. Braid installation takes place much more slowly than do the other stages. Furthermore, although using a tight braid is advantageous in order to enable its interstices to be properly closed by the molten metal, it makes it more difficult and less reliable for the molten metal to flow through the braid so as to bond it to the tape and also close the line of opening at the edges of the tape. Furthermore, the use of a bath of molten solder requires safety devices to avoid the risk of burning and of inhaling vapor.

OBJECTS AND SUMMARY OF THE INVENTION

An object of the present invention is to provide a flexible coaxial cable having a shield of reliable structure leading to performance that is excellent and stable over time, and suitable for being manufactured by means of a method that is simple and fast.

The present invention provides a flexible coaxial cable comprising a flexible conductive core, flexible insulation around said core, and a flexible metal shield around said insulation, said shield comprising a first metal tape provided with a metal coating on at least one face thereof and wound helically around said insulation so as to present successive turns that overlap in a helical overlap zone that is continuous along said cable, wherein said first tape is closed in leakproof manner onto itself throughout said overlap zone between said turns by said coating bonding said turns to one another.

Likewise, the invention also provides a flexible coaxial cable comprising a flexible conductive core, flexible insulation around said core, and a flexible metal shield around said insulation, said shield comprising a first metal tape and an outer second metal tape, both tapes being wound helically around said insulation, and at least one of said tapes being provided with a metal coating on at least one of its faces, wherein each of said tapes presents turns leaving a respective helical gap that is continuous along said cable, wherein said turns of said second tape completely overlap the gap in the first tape and partially overlap the turns of said first tape, and wherein the overlap zones between the turns of said tapes are bonded together in leakproof manner by said coating provided on at least one of the two facing faces of said tape.

Advantageously, the cable presents at least one of the following additional characteristics:

- said first tape has a winding pitch lying in the range 0.2 millimeters (mm) to 10 mm and said cable has a diameter across said insulation lying in the range 0.2 mm to 8 mm; and
- said shield includes an inner metal tape placed longitudinally directly around said insulation, and having edges that overlap.

The invention also provides a method of manufacturing said cable, the method consisting in subjecting the cable provided with said shield to peripheral heating to bond together the turns of each tape constituting said shield, without external bonding material being supplied.

Advantageously, the peripheral heating for bonding is provided by means of an induction coil powered at high frequency and provided on a manufacturing line for making said shield continuously.

BRIEF DESCRIPTION OF THE DRAWING

The characteristics and advantages of the invention will appear more clearly on reading the following description given with reference to the accompanying drawing, in which.

MORE DETAILED DESCRIPTION

Figure 1:
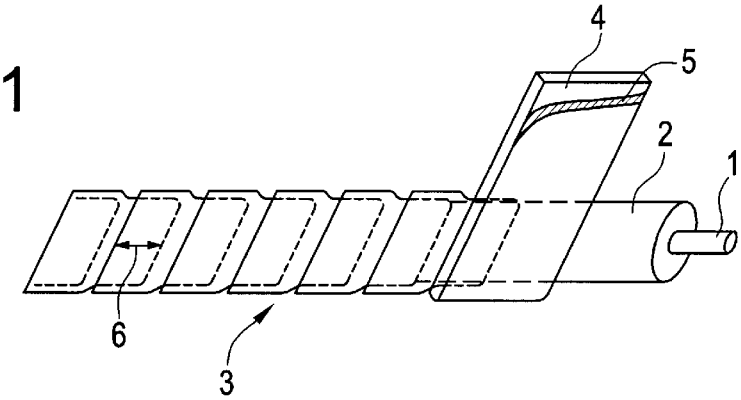
FIG. 1 is a perspective view of a first embodiment of a flexible coaxial cable of the invention.

With reference to FIG. 1, the cable comprises a flexible conductive core 1, flexible insulation 2 covering said core, and a flexible shield 3 surrounding said insulation.

The flexible shield 3 is constituted by a metal tape 4 which is provided with a metal coating 5 at least on its outside face, which is wound helically around the insulation, with turns that overlap widely, and which is sealed onto itself in leakproof manner by said coating bonding said turns to one another throughout their overlap zones.

The overlap referenced 6 between the turns is shown as being 50%. In practice, it can be less than that but it must nevertheless be not less than 20% to 25% and is preferably about 40%. It defines an overlap zone that is bonded together without any additional material being supplied, which zone is helical and continuous along the cable so as to provide good sealing and conservation of the performance of the shield 3 made in this way.

In the cable, the conductive core 1 is a solid single conductor core or a twisted multistrand core, e.g. of bare copper, tinned copper, silver-plated copper, or of copper alloy or indeed a steel covered in copper.

The insulation is a conventional or expanded dielectric, such as PTFE, FEP, PFA, PE, or PP, for example. The shield 4 is preferably made using a tinned copper tape, with the coating of tinning melting so as to solder the turns directly to one another over the entire overlap zone. The tape 4 can be tinned on both faces.

The cable is advantageously a coaxial cable whose diameter across the insulation 2 lies in the range 0.2 mm to 8 mm. The tape 4 that is used has a width of 0.2 mm to 15 mm and has a winding pitch lying in the range 0.12 mm to 10 mm, depending on the diameter of the insulation.

Naturally, the cable can be provided with an outer protective sheath which is optional and not shown.

Figure 2:
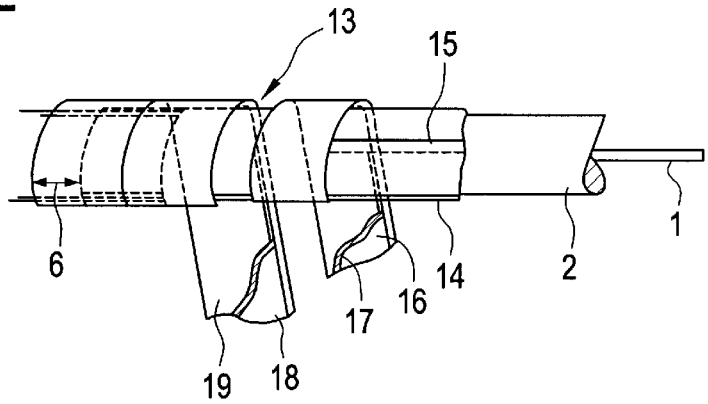
FIG. 2 is a perspective view of another embodiment of a flexible coaxial cable of the invention.
Figure 3:
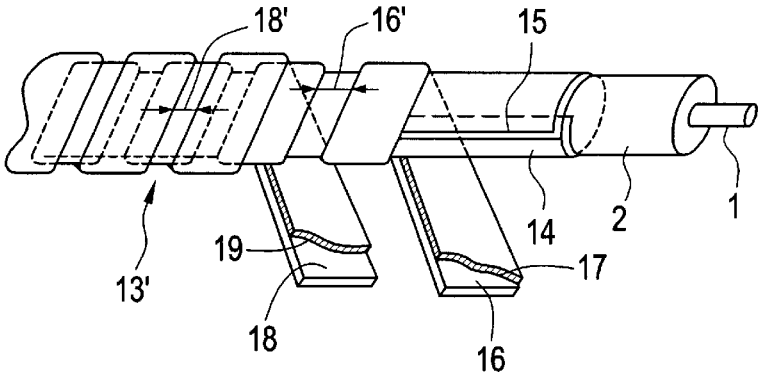
FIG. 3 is a perspective view of another embodiment of a cable of the invention.

With reference to FIGS. 2 and 3, references 13 or 13' designate a shield made around insulation 2 on a conductive core 1. The metal shield 13 or 13' comprises:

an inner tape 14 which is placed lengthwise directly around the insulation 2 and which has its edges overlapping longitudinally, as shown at 15;

an intermediate tape 16 wound helically around the tape 14; and an outer tape 18 wound helically around the tape 16.

The tape 14 is advantageously constituted by a plastic/metal laminate whose plastics face is against the insulation 2. The tapes 16 and 18 are advantageously metal tapes, e.g. copper tapes, provided with metal coating layers 17 and 19, e.g. of tin or based on tin, and at least on their inside faces.

The tapes 16 and 18 are wound in the same direction and at the same pitch, being offset relative to each other by about one-fourth to three-fourths of the winding pitch. They are soldered together and to the tape 14 by the coatings 17 and 19.

In FIG. 2, each of the two helical tapes 16 and 18 has its turns overlapping widely. The inner longitudinal tape 14 is optional.

In FIG. 3, each of the helical tapes 16 and 18 leaves a gap 16' or 18' between its turns, with the gap being continuous all along the cable. The turns of the outermost helical tape 18 completely cover the gap 16' of the tape 16 and partially cover the turns thereof. The longitudinal tape 14 is optional in the cable shield.

The cable of FIG. 2 or FIG. 3 can also have an outer protective sheath (not shown). Its dimensions and the winding pitch for its helical tapes are the same as those specified for the cable of FIG. 1.

With reference to FIG. 1, it should be observed that the cable can have a longitudinal tape (such as the tape 14 in FIG. 2 or FIG. 3) under the helical tape 4, in which case the helical tape is provided with an inner metal coating and optionally with the outer metal coating 5.

Figure 4:
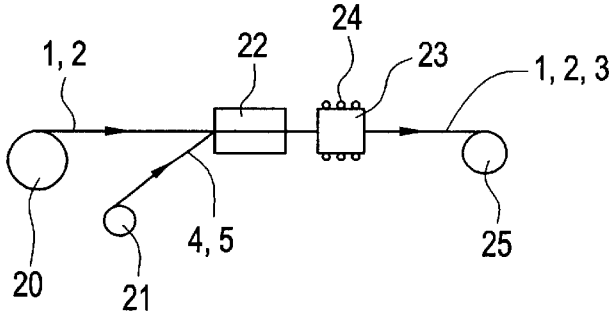
FIG. 4 is a diagrammatic view illustrating the method of making the cable of FIG. 1.

The method of continuously manufacturing the shield 3 on the conductive core 1 inside its insulation 2 in a production line is shown in FIG. 4. The insulated conductive core 1 given references 1, 2 is taken from a storage reel 20 and passes through a taping station 22 which receives the tape 4 provided with its coating 5. The tape is taken from a roll 21 and is wound helically around the insulated core, as described with reference to FIG. 1. The cable together with its tape then passes through a station 23 for soldering the turns of the tape to one another, where soldering is performed directly by the coating 5 without any additional solder being supplied. For this purpose, the soldering station has an induction coil 24 that is powered at high frequency so as to melt the coating 5 and thus solder the turns to one another. The cable provided with its shield 3 sealed in leakproof manner in this way is stored on a takeup reel 25.

Naturally, continuous in-line manufacture of the shield 13 or 13' for the cable shown in FIG. 2 or FIG. 3 is obtained in analogous manner, where appropriate, by placing the optional inner tape lengthwise around the insulating core followed by the first helical tape and finally the second helical tape on the outside, and then causing the cable to pass through the above-described soldering station. The cable is then stored on a takeup reel.

What is claimed is:

1. A flexible coaxial cable comprising:

a flexible conductive core, flexible insulation around said core, and a flexible metal shield around said insulation, said shield comprising a first metal tape provided with a metal coating on at least one face thereof and wound helically around said insulation so as to present successive turns that overlap in a helical overlap zone that is continuous along said cable, wherein said first tape is closed in a leakproof manner onto itself throughout said overlap zone between said turns by said coating which bonds said turns so that said turns are soldered to one another and so that said first tape is sealed onto itself.

2. A cable according to claim 1, wherein said shield further includes an inner metal tape placed longitudinally directly around said insulation, and having edges that overlap.

3. A cable according to claim 2, wherein said inner tape is a plastic/metal laminate.

4. A cable according to claim 1, wherein said first tape has a winding pitch lying in the range 0.2 mm to 10 mm and said cable has a diameter across said insulation lying in the range 0.2 mm to 8 mm.

5. A cable according to claim 1, wherein said tape provided with the metal coating is made of tinned copper.

6. A method of manufacturing a cable according to claim 1, the method consisting in subjecting the cable provided with said shield to peripheral heating to band together the turns of each tape constituting said shield, without external bonding material being supplied.

7. A method according to 6, consisting in providing said peripheral heating for bonding by means of an induction coil powered at high frequency and provided on a manufacturing line for making said shield continuously on the cable, and having said cable passing therethrough.

8. A flexible coaxial cable comprising:

a flexible conductive core, flexible insulation around said core, and a flexible metal shield around said insulation, said shield comprising a first metal tape provided with a metal coating on at least one face thereof and wound helically around said insulation so as to present successive turns that overlap in a heilical overlap zone that is continuous along said cable, wherein said first tape is closed in leakproof manner onto itself throughout said overlap zone between said turns by said coating bonding said turns to one another, including a second metal tape wound helically on the first tape and having turns that overlap one another, the second tape being provided with a metal coating on at least one of its faces that faces said first tape and having its turns bonded to one another and to the turns of said first tape.

9. A flexible coaxial cable comprising a flexible conductive core, flexible insulation around said core, and a flexible metal shield around said insulation, said shield comprising a first metal tape and an outer second metal tape, both tapes being wound helically around said insulation, and at least one of said tapes being provided with a metal coating on at least one of its faces, wherein each of said tapes presents turns leaving a respective helical gap that is continuous along said cable, wherein said turns of said second tape completely overlap the gap in the first tape and partially overlap the turns of said first tape, and wherein the overlap zones between the turns of said tapes are bonded together in leakproof manner by said coating provided on said at least one of the two facing faces of said at least one tape.

10. A cable according to claim 9, wherein said shield further includes an inner metal tape placed longitudinally directly around said insulation, and having edges that overlap.

11. A cable according to claim 10, wherein said inner tape is a plastic/metal laminate.

12. A cable according to claim 9, wherein said first tape has a winding pitch lying in the range 0.2 mm to 10 mm and said cable has a diameter across said insulation lying in the range 0.2 mm to 8 mm.

13. A cable according to claim 9, wherein each tape provided with the metal coating is made of tinned copper.

14. A method of manufacturing a cable according to claim 9, the method consisting in subjecting the cable provided with said shield to peripheral heating to bond together the turns of each tape constituting said shield, without external bonding material being supplied.

15. A method according to claim 14, consisting in providing said peripheral heating for bonding by means of an induction coil powered at high frequency and provided on a manufacturing line for making said shield continuously on the cable, and having said cable passing therethrough.

* * * * *